US005616873A

United States Patent [19]

Fishman et al.

[11] Patent Number: 5,616,873

[45] **Date of Patent: *Apr. 1, 1997**

[54] STRINGED MUSICAL INSTRUMENT

[76] Inventors: Lawrence R. Fishman, 22 Calumet Rd., Winchester, Mass. 01887; Kenneth Parker, 12 Old Town Rd., Seymour, Conn. 06483

[ * ] Notice: The term of this patent shall not extend beyond the expiration date of Pat. No. 5,125,312.

[21] Appl. No.: 275,157

[22] Filed: Jul. 14, 1994

Related U.S. Application Data

[60] Continuation-in-part of Ser. No. 862,975, Apr. 3, 1992, Pat. No. 5,337,644, which is a division of Ser. No. 352,154, May 15, 1989, Pat. No. 5,125,312.

[51] Int. Cl.[6] ..... G10D 3/00

[52] U.S. Cl. ..... 84/293; 84/452 R

[58] Field of Search ..... 84/293, 267, 268, 84/275, 452 R, 452 P, 291

[56] References Cited

U.S. PATENT DOCUMENTS

| | | | |
|---|---|---|---|
| 3,699,836 | 10/1972 | Glasser | 84/291 |
| 4,200,023 | 4/1980 | Kaman | 84/293 |
| 5,125,312 | 6/1992 | Fishman et al. | 84/291 |
| 5,189,235 | 2/1993 | Fishman et al. | 84/291 |

*Primary Examiner*—Cassandra C. Spyrou
*Attorney, Agent, or Firm*—Wolf, Greenfield & Sacks, P.C.

[57] ABSTRACT

A light weight guitar neck construction and associated method of manufacture involves the use of a wood core with a strengthening layer, preferably of carbon fiber, and a finish layer, preferably a fiberglass sheet, both impregnated with a high temperature resin. A tensioning wire is provided in the neck, and is non-braided with a diameter of less than 0.100 inches.

10 Claims, 14 Drawing Sheets

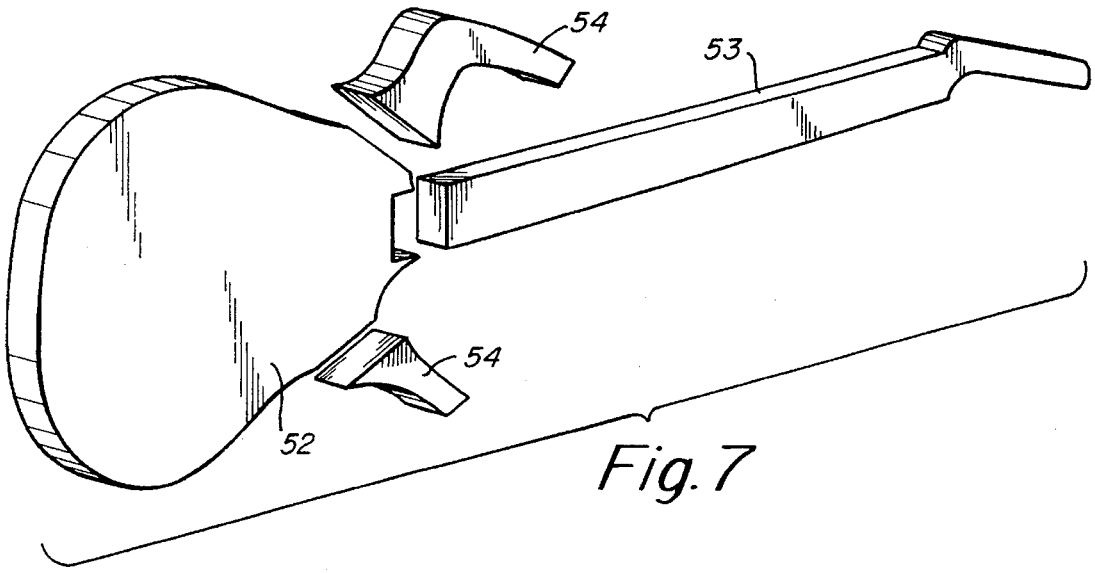
Fig. 7
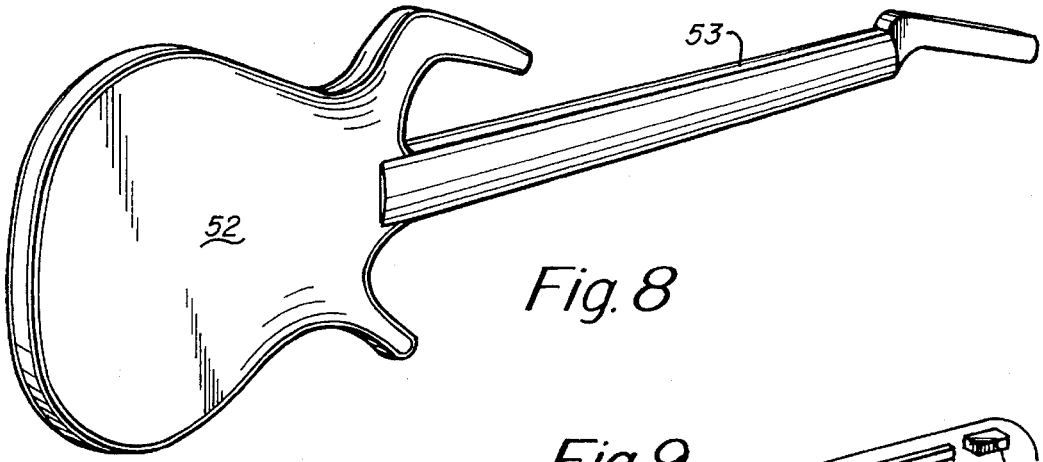
Fig. 8
Fig. 9
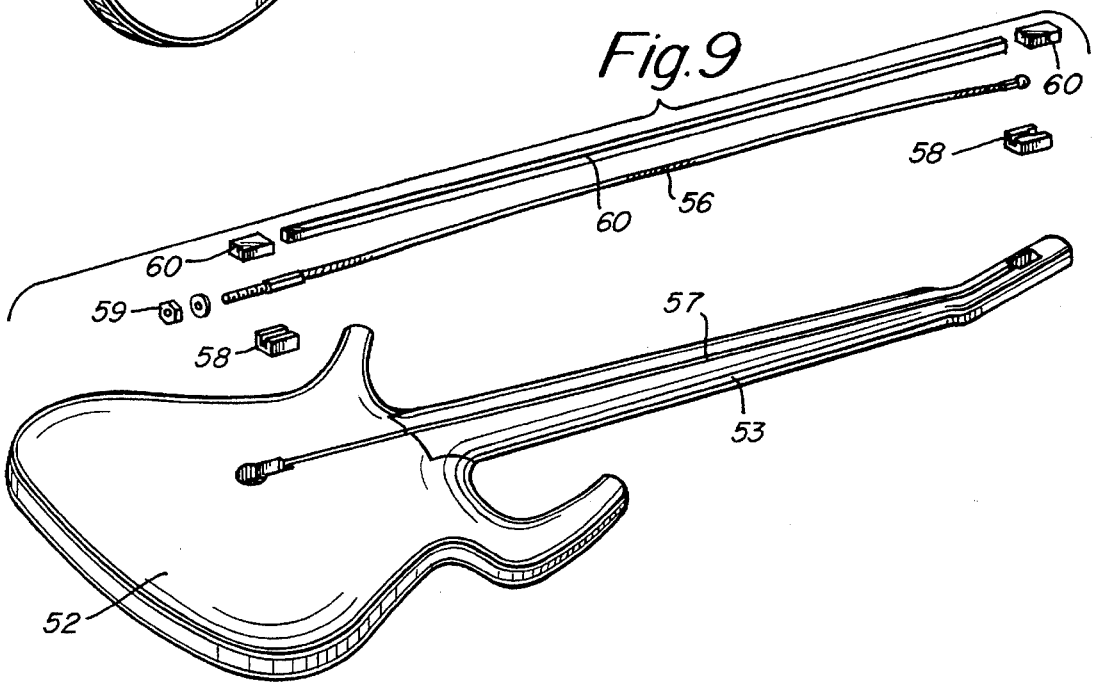

58
60
53
78
75
64
92
56
52
62
91
16
94
26
95
27
96
93
-
+

STRINGED MUSICAL INSTRUMENT

CROSS-REFERENCE TO RELATED APPLICATIONS

The present application is a continuation-in-part application of application Ser. No. 07/862,975, filed Apr. 3, 1992 now U.S. Pat. No. 5,337,644, which is a divisional application of Ser. No. 07/352,154, filed May 15, 1989, now U.S. Pat. No. 5,125,312, issued on Jun. 30, 1992.

FIELD OF THE INVENTION

The present invention relates to a stringed musical instrument, and in particular to instrument components such as a neck for a guitar.

BACKGROUND OF THE INVENTION

Although attempts have been made to construct light-weight musical instruments, particularly guitars, these efforts have not been totally successful in constructing guitars of weights on the order of 5 pounds or less. Fabrication techniques have tended to be complex, time consuming, and in some instances cost prohibitive. U.S. Pat. Nos. 5,125,312 and 5,189,235, which are assigned to the same assignee as the present invention, discuss light-weight musical instruments, and are hereby incorporated by reference. The neck of a guitar can add considerable weight to the instrument, so it would be desirable to make the neck lighter, while still producing a high quality instrument.

SUMMARY OF THE INVENTION

The present invention features a method of fabricating a light-weight component, such as a neck, for a musical instrument, and an instrument component, such as a neck. The instrument is fabricated with a solid wood core, preferably a light-weight soft wood. Disposed over the neck core is a strengthening layer and a finish layer which are preferably formed as a laminate to the outer surface of the core. The strengthening layer may be provided by one or more thin layers of carbon fiber while the finish layer preferably includes a thin layer of a fiberglass sheet. A high temperature resin material is preferably employed in the laminate, and heat is applied to cure the layers. Heat may be applied while subjecting the neck to a vacuum by disposing the neck in a vacuum bag.

In accordance with another aspect of the invention, a light-weight neck has a wood core and a laminate including a strengthening layer and an outer finish layer. The strengthening layer preferably includes a layer of carbon fiber, and the finish layer preferably includes a thin layer of fiberglass sheet. The neck has a channel for holding a non-braided tensioning wire with a diameter of no more than about 0.100 inches, and preferably about 0.060 to 0.078 inches. This wire is substantially thinner and lighter than braided cables and rods that have previously been used. The wire has anti-rotation end pieces which are preferably swaged onto one end of the wire. The other end is accessible to a user with a tool for adjusting the tension.

In another aspect, the invention features a resilient spring for providing an electrical connection, such as a ground path, between a cap that is on one side of a piezoelectric element and a conducting member that is on the other side of the element. The spring is preferably a corrugated strip of beryllium copper that is arranged in an annular region around the cap and the conductive member.

BRIEF DESCRIPTION OF THE DRAWINGS

Other features and advantages of the invention will become apparent upon a reading of the following detailed description taken in conjunction with the accompanying drawings, in which:

FIG. 7 is a perspective view of a wood core of the instrument;

FIG. 8 is a perspective view of assembled wood parts;

FIG. 9 is a perspective view of a rear surface of the guitar, further illustrating a tensioning cable employed in accordance with the invention;

DETAILED DESCRIPTION

Figure 1:
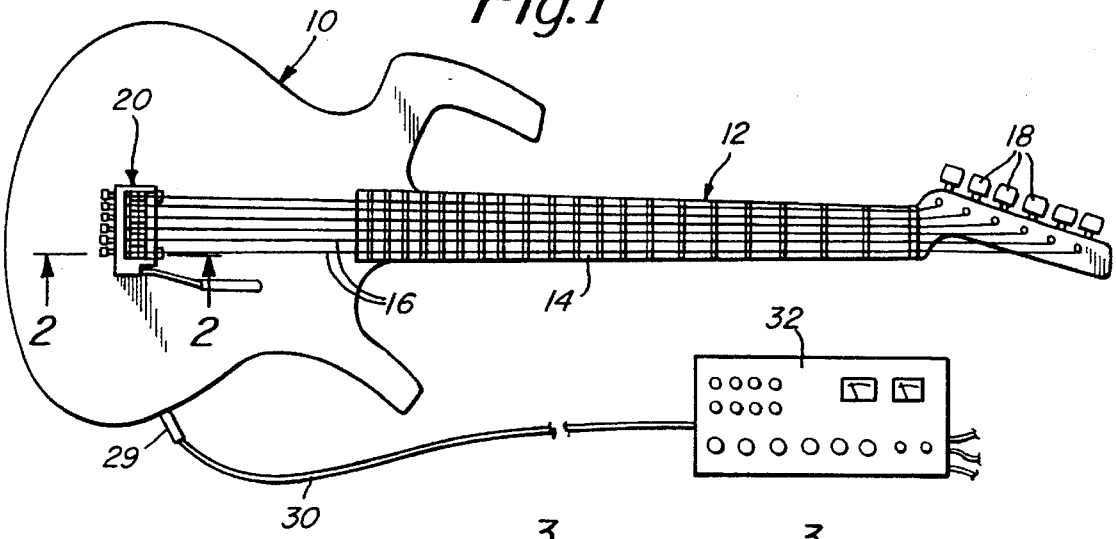
FIG. 1 is a plan view of a guitar constructed in accordance with the present invention.

Referring to FIG. 1, a guitar constructed in accordance with the present invention has a body 10 and a neck 12, which supports a fret board 14. Strings 16 are supported at the neck and at the body. At the neck, the strings may be supported in a conventional fashion with adjusting pegs 18. Strings 16 are supported at the body end at a bridge mechanism 20.

Figure 2:
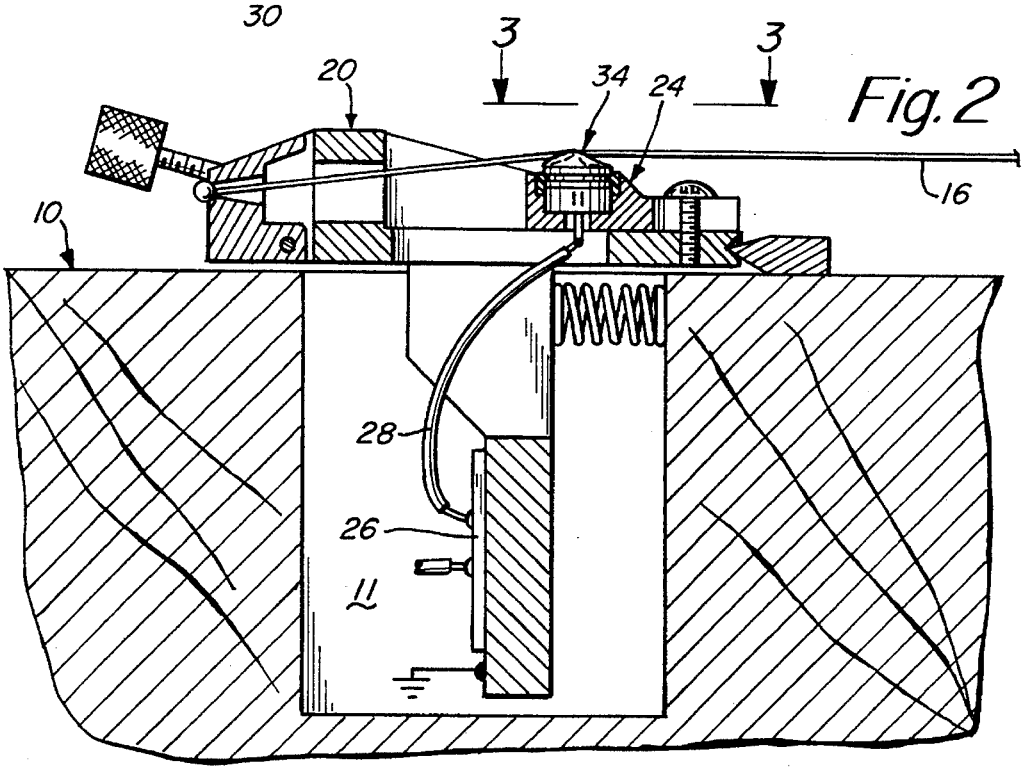
FIG. 2 is a fragmentary cross-sectional view showing details of a transducer system employed on the instrument.
Figure 3:
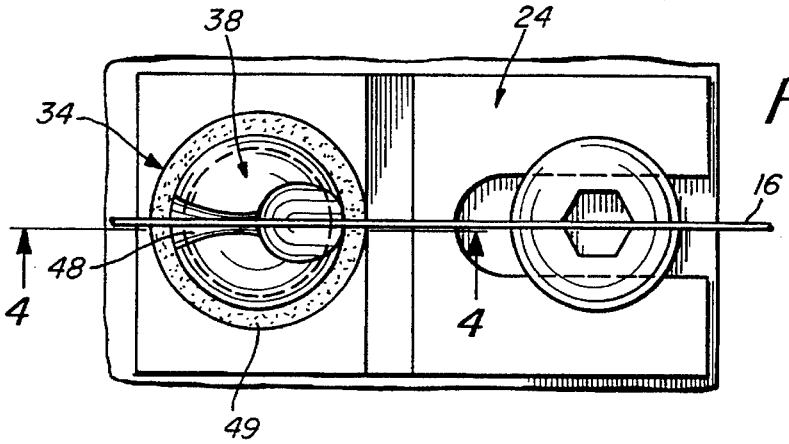
FIG. 3 is a plan view taken along line 3—3 of FIG. 2.

In FIGS. 1–3, bridge mechanism 20 is illustrated as a tremelo bridge, however, the bridge mechanism may also be a fixed bridge type. Bridge mechanism 20 is partially received in a cavity 11 in the instrument body. For further details of parts of the bridge mechanism, refer to Fishman, U.S. Pat. No. 4,911,057, issued Mar. 27, 1990.

The bridge mechanism 20 includes a holder 24, which in a fixed bridged construction would be held in a fixed position, although one might be adjustable. The bridge mechanism 20 also supports a circuit board 26 supported in the cavity 11. As shown in FIG. 3, a lead wire 28 connects a piezoelectric transducer to circuit board 26. A jack 29 and a cable 30 are connected to an electronic device 32, which may an amplifier or synthesizer. Inside the guitar, circuit board 26 may have lines coupling to jack 29 so that signals from the piezoelectric crystals are coupled by cable 30 to device 32.

Figure 4:
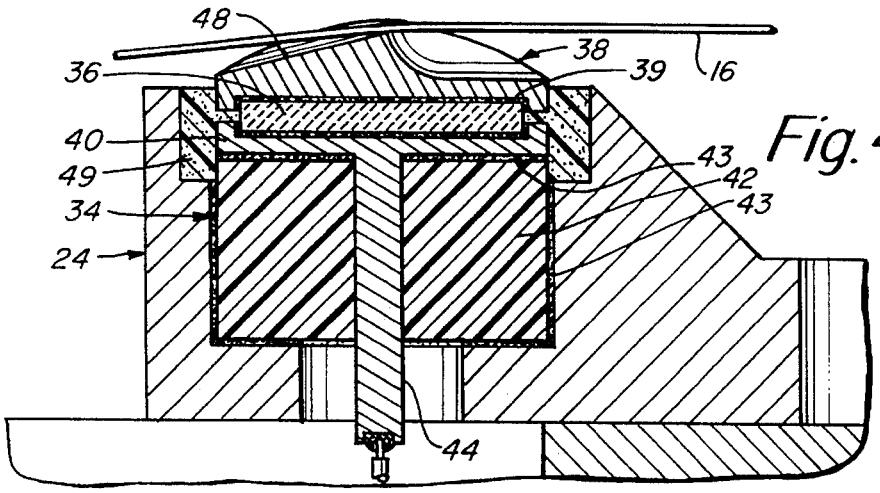
FIG. 4 is a cross-sectional view taken along line 4—4 of FIG. 3 and showing further details of the transducer construction.
Figure 5:
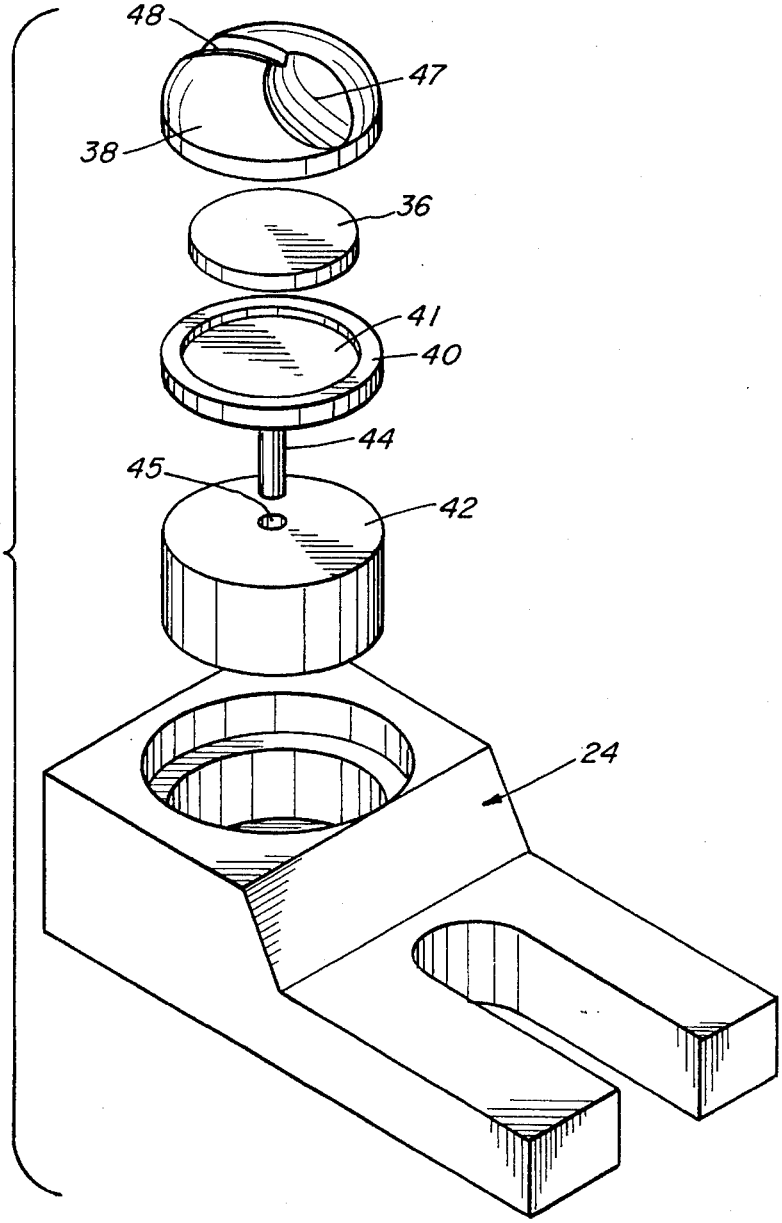
FIG. 5 is an exploded perspective view of the components of the transducer illustrated in FIGS. 2–4.
Figure 6:
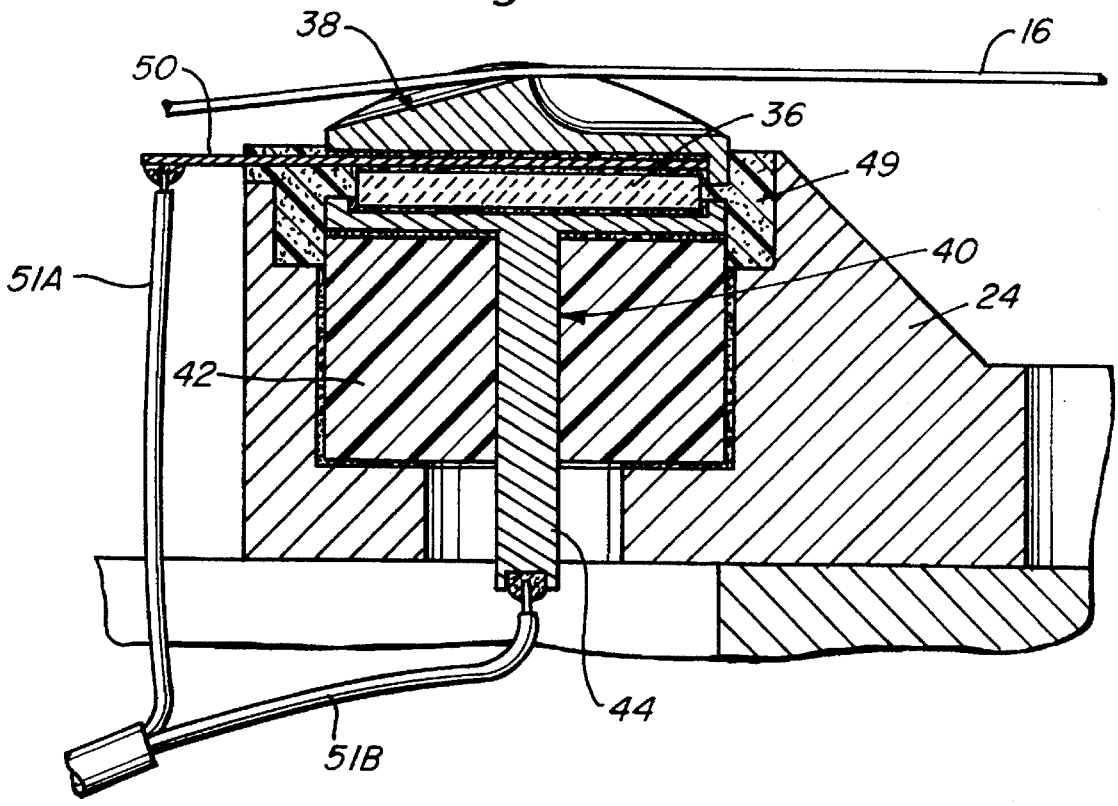
FIG. 6 is a cross-sectional view of an alternate embodiment of the transducer.

FIGS. 2–6 illustrate transducer assembly 34 secured in holder 24. Transducer assembly 34 includes a thin piezoelectric disk 36, a cap member 38, a metallic member 40, and a dielectric member 42. The facing surfaces of the cap member and metallic support member have recesses such as the recess 41 (FIG. 5). These recesses partially accommodate piezoelectric disk 36. Metallic support member 40 has a terminal post 44 that is adapted to pass through hole 45 in dielectric base member 42. As shown in FIG. 4, terminal post 44 extends downwardly below the bottom surface of dielectric base member 42. A lead wire is soldered to the bottom end of terminal post 44. Cap member 38 is of generally domed construction. Within the domed cap member a recess 47 is contiguous with a slot 48. Musical string 16, as shown in FIG. 3, is disposed in slot 48.

To secure the piezoelectric crystal 36 in place between the cap member 38 and the support member 40, a conductive adhesive layer 34 may be applied. This electrical layer couples the oppositely disposed upper and lower electrodes of the piezoelectric crystal to the respective cap member and metallic support member. Cap member 38 is electrically coupled by way of string 16 to other metallic parts of the guitar which may be considered as functioning as a ground. Non-conductive dielectric bonding 43 is provided to secure metallic support member 40 and dielectric member 42 as well dielectric member 42 and holder 24. A dielectric potting compound 49 is disposed about the transducer assembly.

In the transducer assembly, cap member 38 is preferably constructed of a hard metal material such as of stainless steel. The piezoelectric disk is of a piezoelectric crystal material. The metallic support member may be constructed of a softer metal material, such as brass. The adhesive materials may be epoxy adhesives, either conductive or non-conductive as previously described.

In one prior transducer construction, such as that illustrated in U.S. Pat. No. 4,774,867, the piezoelectric disk is bonded essentially only on one surface to increase output voltage. For this application, it is preferred to have the crystal bonded on both upper and lower faces with conductive epoxy 39. Bonding on both surfaces provides a more accurate output signal and better representative of the true mechanical string vibration. By essentially clamping both sides of the crystal a lower output voltage is provided. This means that the crystal is less sensitive to the compressive mode but is more sensitive to the rotational shear mode. This clamping better replicates the true mechanical string vibration. The hardness of potting compound 49 is instrumental and can be controlled so as to provide an accurate replication of the desired string vibration signal. Potting compound 49, in particular allows one to tune the shear mode, thus controlling the level of lateral clamping. The amount of clamping relates to the durometer hardness of the potting compound that is employed.

The piezoelectric type of transducer of the present invention is an improvement over previously used magnetic transducers. These magnetic transducers, inter alia, are generally more cumbersome and require the use of ferrous strings. The piezoelectric transducer is more readily tunable and is constructed to desensitize the compressional mode. As such, the transducer is constructed to be less responsive to mechanical vibrations, such as those from the instrument body.

With a piezoelectric transducer of this type, one can electronically add resonance to replicate a magnetic transducer. In this way a wide variety of sounds can be provided with piezoelectric transducers. Also, the piezoelectric type of transducer does not have To be used with ferrous strings but can be used with any type of string material.

As shown in FIG. 4, if a string breaks, the ground path is interrupted. As this may be of concern, an embodiment of the invention such as that illustrated in FIG. 6 may then be employed. The transducer assembly has cap member 38, metallic support member 40, dielectric member 42, and piezoelectric disk 36, which are mounted in substantially the same way as described in connection with FIG. 4. A conductive epoxy adhesive is used for securing the piezoelectric disk. Between the top surface of the piezoelectric disk and cap member 38, conductive leaf 50 extends outwardly. Leads 51A and 51B are solder connected respectively to leaf 50 and to terminal post 44. In an alternate arrangement, in place of the solder-connections illustrated in FIG. 6, a push on connector may be provided in place of the solder thus simplifying construction. With the arrangement of FIG. 6, should string 16 break, there is still an electrical connection to ground by way of lead 51A.

Figure 35:
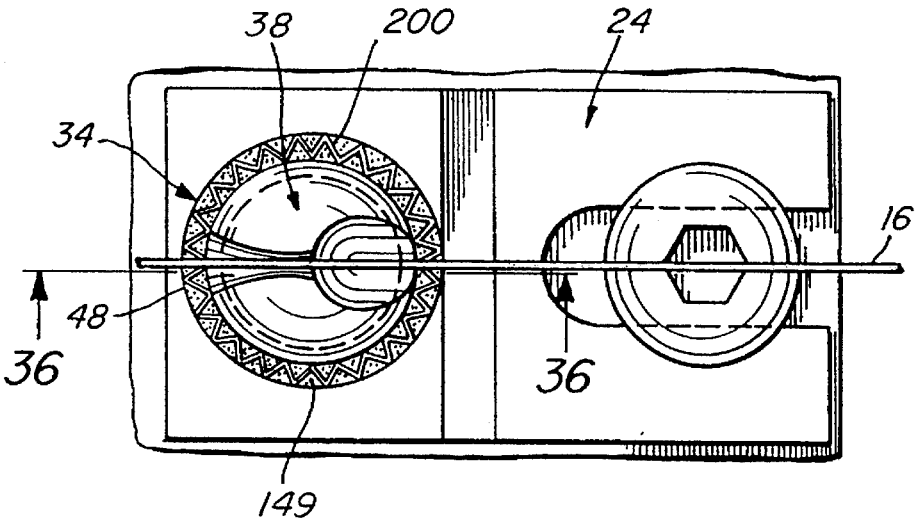
FIG. 35 is a plan view of an alternative embodiment of the transducer assembly and is similar to FIG. 3.
Figure 36:
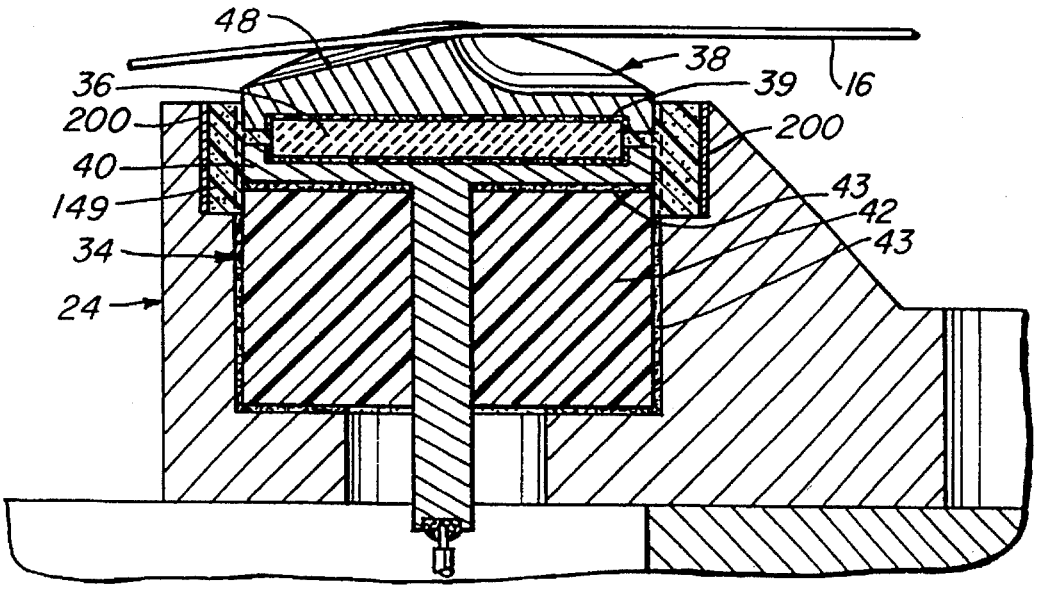
FIG. 36 is a cross-sectional view taken along the line of 36—36 of FIG. 35.

An alternative arrangement to that shown in FIGS. 3 and 4 is shown in FIGS. 35 and 36. A spring 200 that is preferably made from a strip of beryllium copper is provided around cap member 38 and provides an electrical path between cap member 38 and metallic member 40. The spring is preferably arranged in a corrugated manner to provide a conductive path while still being resilient to provide more accurate vibration detection. A compound 149, similar to compound 49 in the embodiment of FIGS. 2 and 3, may be provided in the space along with the spring 200.

As an alternative to the corrugated copper spring, stainless steel wool can be used since it too is conductive and also resilient. Since the wool is made from stainless steel, it does not rust like typical steel wool.

FIGS. 7–12 illustrate details relating to the construction of the guitar invention. A body 52, a neck 53 and arms 54 have a basic wood core. Body 52 and arms 54 may be cut from about 1½ inch thick redwood material, while the neck 53 is preferably cut from about 1 inch Douglas fir or bass wood. The arms may be separate pieces, or body 52 and arms 54 may be integrally formed from a single integral block of wood.

The wood core materials are preferably soft wood materials which are lighter in weight and are more well balanced tonally than hard woods that are typically used. Such woods are also less expensive, easier to cut and shape, and dimensionally stable than a hard wood core. With a soft wood core, rigidity and strength are provided with a laminate construction according to the present invention, in combination with a stiffening or tensioning cable.

Referring to FIG. 9, a metal cable or rod, such as a stainless steel cable 56, is received in an elongated recess 57 extending along the neck and into the body. A pair of anti-rotation pieces 58 are connected at each end of cable 56. A nut 59 is used to tighten and control the tension applied by cable 56. Filler pieces 60 are disposed over the cable and over the anti-rotation pieces to fill recess 57.

As an alternative to cable 56, a non-braided, thin metal wire having a dimension of about 0.060" to about 0.078" can be used. An example is described in connection with FIG. 34 below. This smaller wire reduces the weight relative to the use of a thicker, braided cable. Furthermore, the non-braided cable is easier to swage.

The cable may alternatively be secured from the opposite side, such as from the front side of the guitar, in which case the recess would be provided in the front surface.

As indicated, the cable 56 is preferably installed and adjusted from the back of the instrument to provide a clean appearance from the front. The cable can be positioned very close to the back surface of the instrument where it has the most mechanical advantage. The cable adjusts in a place that is convenient in that there is no need to loosen strings or otherwise disturb the instrument to provide this adjustment. Also, since the cable is flexible, adjustment may be made nearly anywhere on the instrument, including at the neck end of the cable or at the body end.

Figure 10:
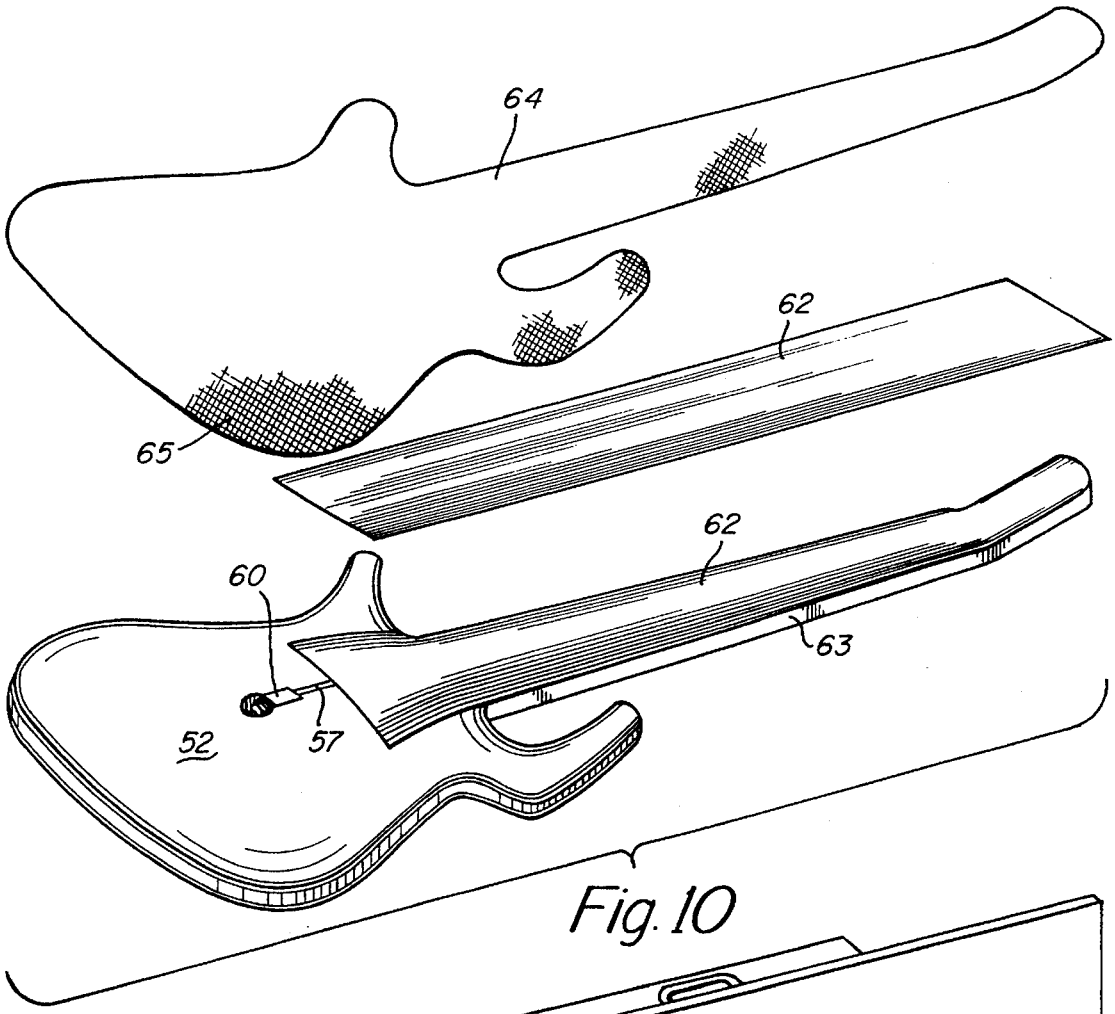
FIG. 10 is an exploded view of components employed in fabricating the guitar, including carbon fiber and fiberglass layers.
Figure 11:
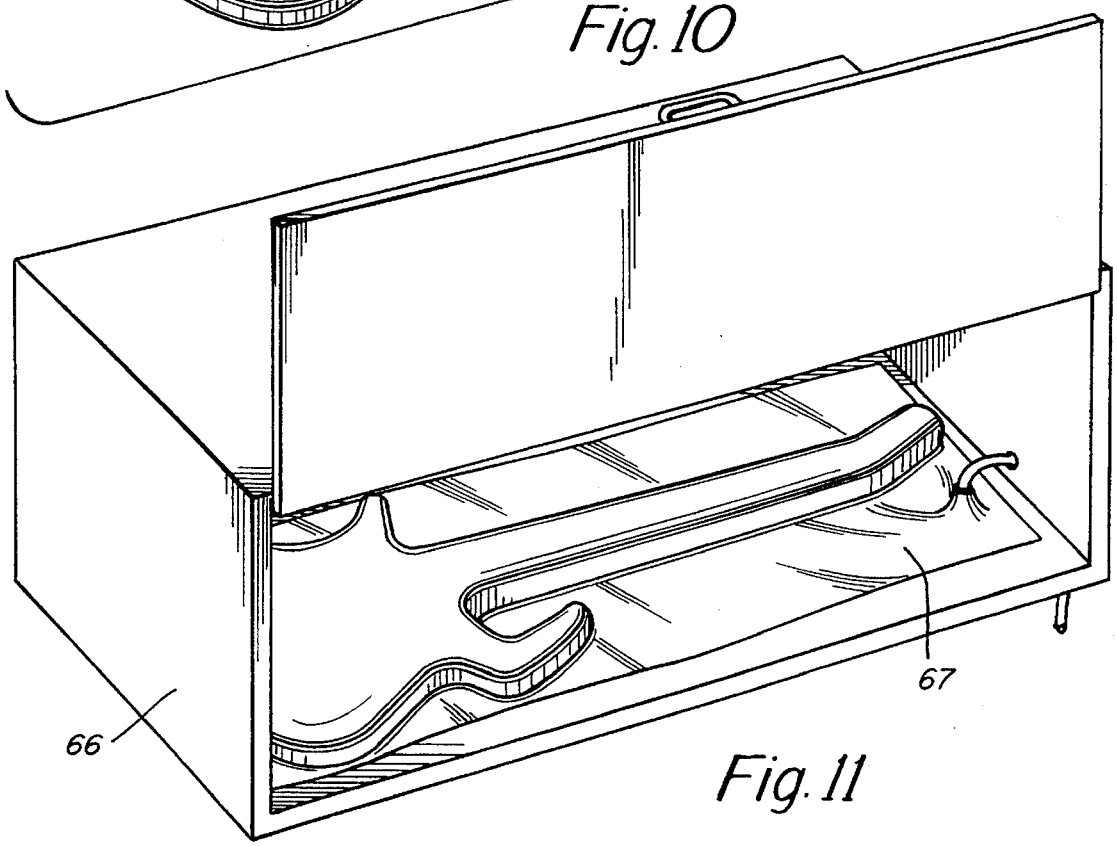
FIG. 11 is a perspective view of a guitar in the process of fabrication.

Referring to FIG. 10, after the body of the guitar has been contoured to the desired configuration, the neck is secured by gluing to the body, preferably using a high temperature epoxy. The glue joints may be angled to facilitate the shaping of the guitar without excess waste of material. In preparing the instrument for the lamination process, a support caul 63 is provided. The stiff caul screws to the fingerboard surface and extends to the body of the instrument. The laminate includes multiple layers 62 of unidirectional carbon fiber are impregnated with a high temperature epoxy resin, and a fiberglass cloth layer 64. Layer 64 is preferably applied with a 45° bias as illustrated at 65. The 45° bias cut enables the fiberglass to better conform to the curves of the core. Layer 64 covers the back of both the body and the neck and can also covers the sides and front of the body as well. The fiberglass cloth is also impregnated with a high temperature epoxy resin. Each of these layers may be about 0.010 inch thick. The fiberglass cloth layer is bias cut and may have a thickness of about 0.003 inch.

Caul 63 supports the neck and headstock in their correct alignment and insures good playability. The caul, which is first treated with a mold release, silicone material, provides a place for the extra laminating material to go and prevents the undesirable condition of excess laminating material being bonded to the fingerboard surface.

After layers 62 and 64 have been impregnated, they are pressed onto the instrument and the laminate is then ready for curing. The guitar is disposed in a vacuum bag 67 (FIG. 11) and placed in an oven 66. The vacuum bag provides clamping pressure for the lamination. The curing occurs at a temperature of about 250° F. for two hours.

Figure 12:
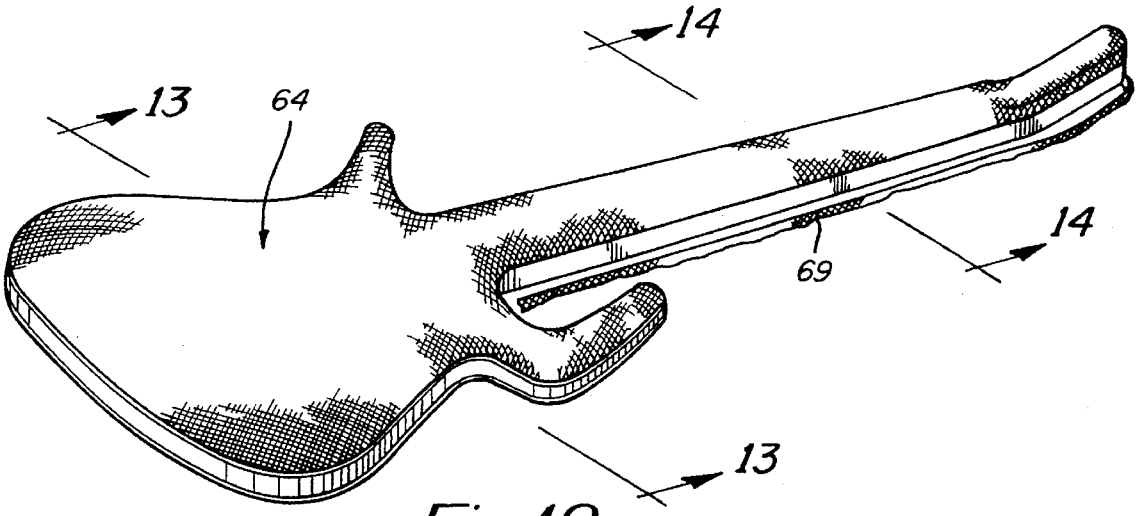
FIG. 12 is a perspective view of the guitar construction after the heating and curing step.

After the instrument is cured, the caul is removed and excess material is knifed off. The laminated edges are smoothed. The headstock and fingerboard surfaces are prepared. In this regard, FIG. 12 shows the instrument after being cured. Sharp edges may be radiused by sanding. Excess material such as illustrated at 69 in FIG. 12 may be trimmed off.

Figure 13:
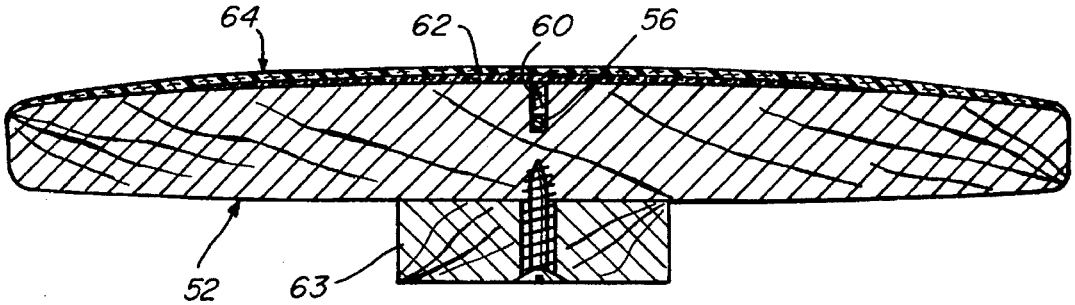
FIGS. 13 and 14 are cross-sectional views taken along the lines 13—13 and 14—14 of FIG. 12, respectively.
Figure 14:
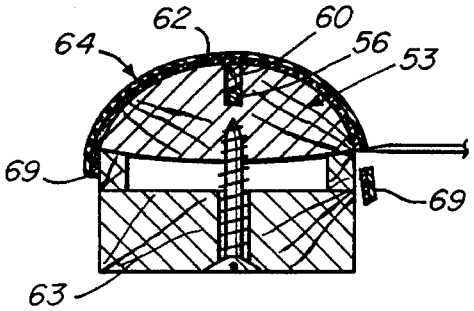

Referring to FIGS. 13 and 14, the cross sectional views are taken at an intermediate step in the fabrication of the guitar. In both FIGS. 13 and 14, caul 63 is still shown affixed to the wood core. FIGS. 13 and 14 also show tension cable 56, the filler piece 60, carbon fiber layer 62 feathered at the edges, and fiberglass layer 64. These same layers are also illustrated in FIG. 14. FIG. 14 also illustrates the excess laminate being trimmed at 69.

Figure 15:
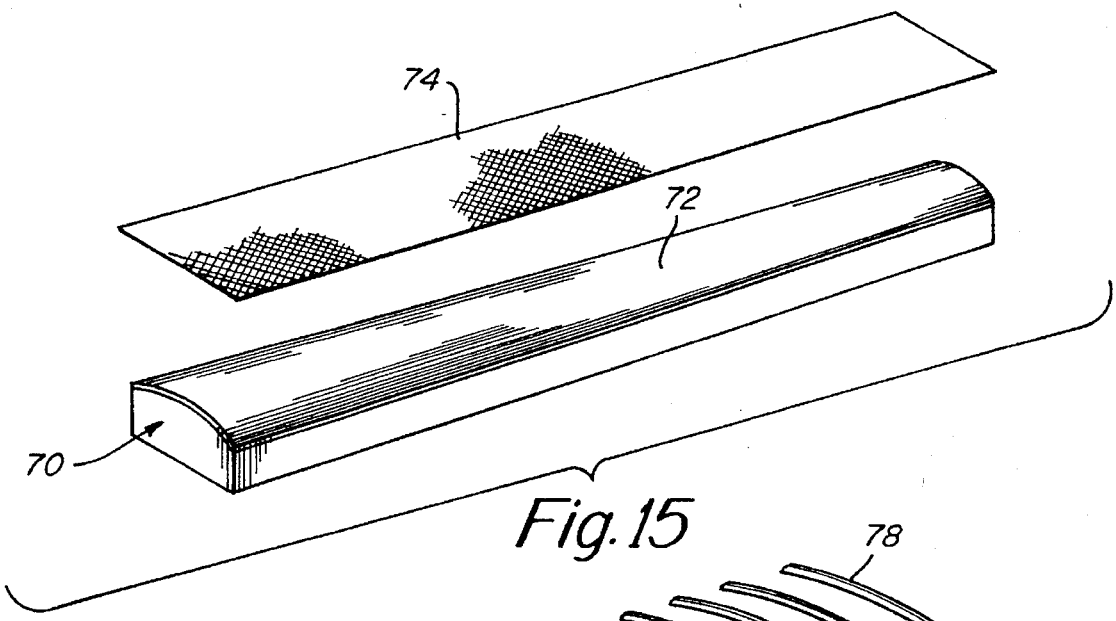
FIGS. 15 and 16 are exploded views of step in the fabrication of the fingerboard.
Figure 16:
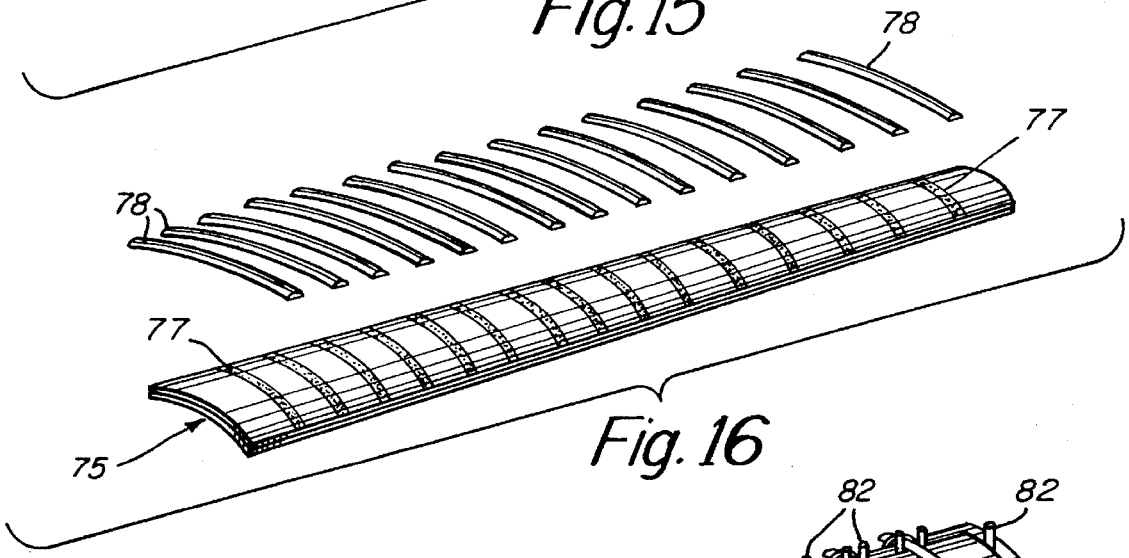

Reference is now made to FIGS. 15–18 for further details in the construction of the instrument fingerboard. In this regard, FIG. 15 shows a basic form 70 that is used to provide the proper contour for the fingerboard. On the top surface of the form 70, a release material, such as a gel, is preferably provided to enable the laminate components to be separated from the form. On top of the form, a uni-directional carbon fiber layer 72, and a bias cut fiberglass sheet 74 are provided. Both layer 72 and sheet 74 may be impregnated with a high temperature resin. The combination of the carbon fiber and the fiberglass on the form is subjected to high temperature in an oven. The arrangement illustrated in FIG. 11 with the use of a vacuum bag may be employed for heating and curing to form laminate 75 as illustrated in FIG. 16.

FIG. 16 shows laminate 75 after having been formed by heating and after having also been trimmed to the proper size for a particular instrument. On the top surface of laminate 75, a mask is employed and the laminate is sandblasted using a mask to form roughened strips 77. These strips are disposed at positions corresponding to positions where the frets are to be secured. Frets 78 are cut to a proper length and partially curved to substantially match the curvature of laminate 75. The underside surface of the frets is also preferably sandblasted. The frets may be cut from a length of stainless steel material of cross-section as shown, for example, in FIG. 23. After sandblasting both the frets and the laminate, epoxy adhesive is applied to enable the frets to be secured onto the laminate. Thus, the frets are made of extremely hard wire, preferably stainless steel, in a construction that is tangless.

Figure 17:
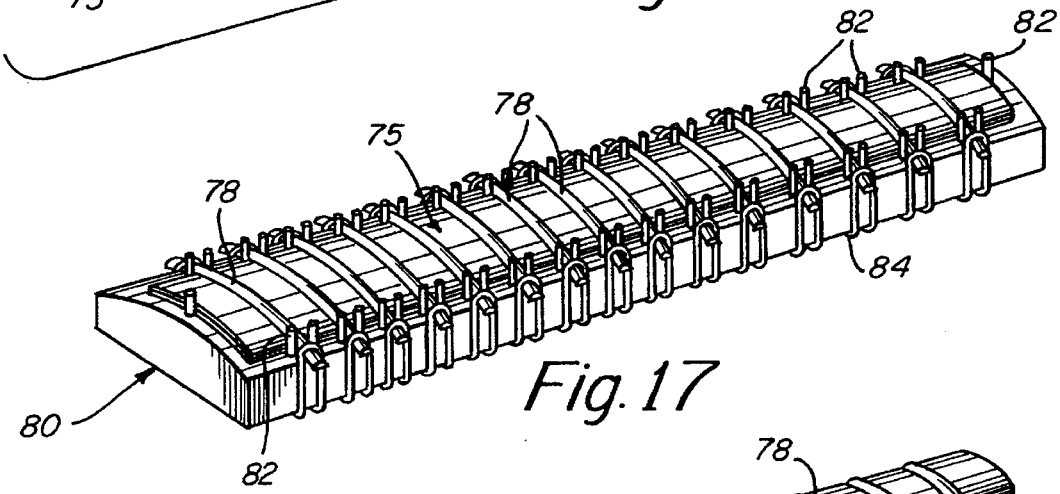
FIGS. 17 and 18 are perspective views of further steps in the fabrication of the fingerboard.
Figure 18:
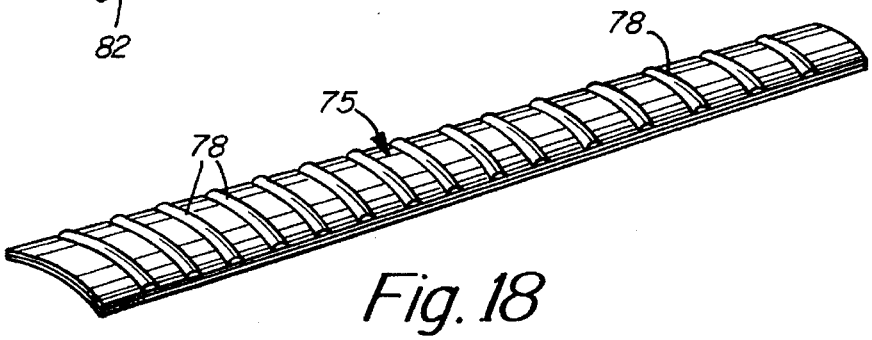

As shown in FIG. 17, a fixture 80 has several locating pins 82 disposed at opposite ends of the fixture 80 for positioning the laminate board longitudinally. Locating pins 82 also locate frets 78. Rubber bands 84 hold frets 78 securely against the laminate 75. With the laminate and frets in the position illustrated in FIG. 17, the assembly is baked. FIG. 18 shows the final fret board including the laminate with the individual frets attached after the ends of the frets are cut and finishing work is done.

Figure 22:
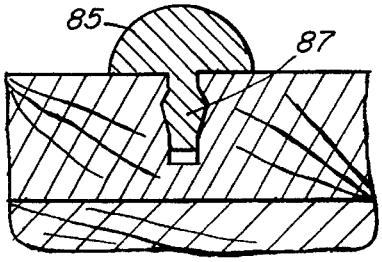
Fig. 22 (PRIOR ART)
FIG. 22 is a fragmentary cross-sectional view of a prior art fret construction.

Reference is now made to FIGS. 19–23 for further details of the fingerboard construction. FIG. 22 in particular shows a prior art tanged fret construction. FIG. 22 shows a conventional fret 85 having a tang 87. These individual frets are constructed of a relatively soft material and are hammered into a slot in the fret board. After the fret has been inserted into the fret board it must then be reformed. The formation of a fret board in this manner is quite time consuming and costly. Because a relatively soft metal is employed, the fret board has to be reworked in the future. On the other hand, according the present invention, the frets are of a hard metal. Rather than inserting these frets into a slot in the fret board, they are adhesively secured to the surface of the fret board. The fret construction of the present invention requires little or no reworking after the frets are applied.

Figure 19:
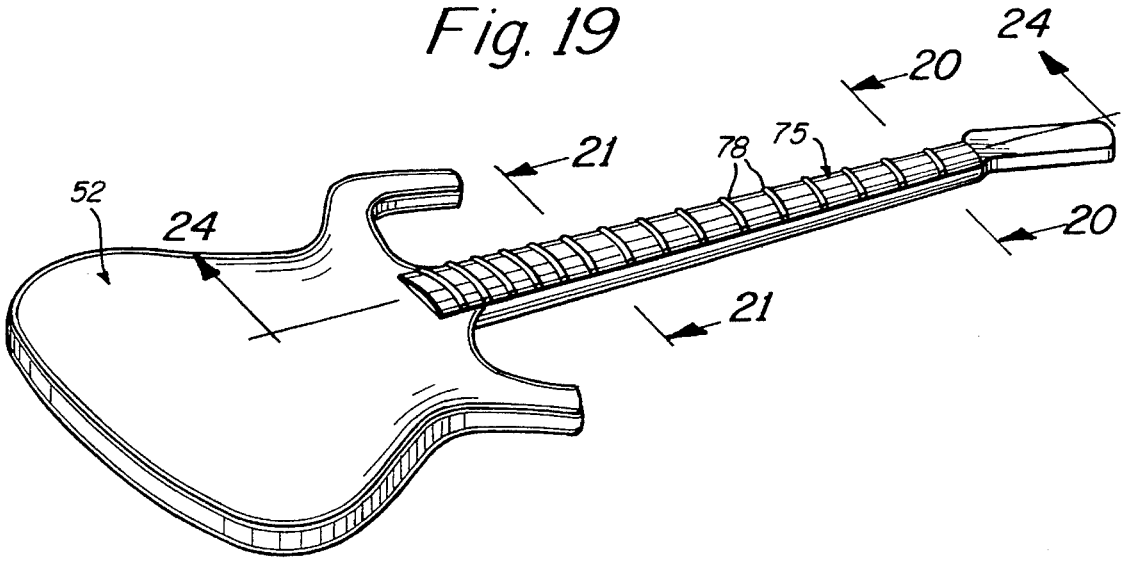
FIG. 19 is a perspective view of the fingerboard of FIG. 18 secured to the neck of the instrument.
Figure 20:
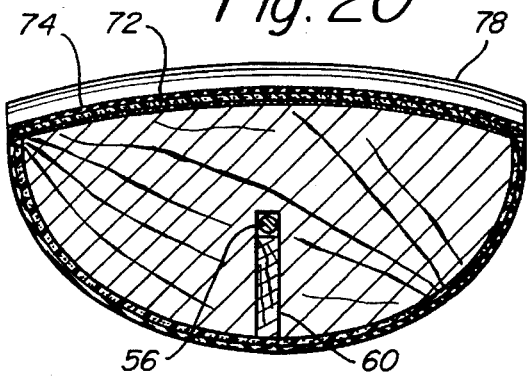
FIGS. 20 and 21 are cross-sectional views taken along lines 20—20 and 21—21 of FIG. 19, respectively.
Figure 21:
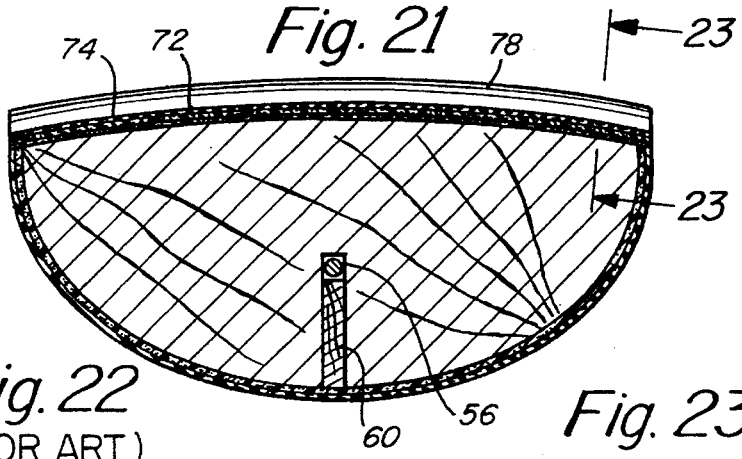

FIG. 19 is a perspective view showing the fingerboard attached to the guitar neck. The fingerboard may be secured to the instrument neck using, for example, a thin film adhesive. This may be provided in a relatively thin film on the order of 0.002 inch thick. Films of this type are preferred over the use of an applied liquid because the films are dimensionally stable and provide an accurate adhesive layer. One thin film adhesive that has been employed is a thermal plastic film adhesive that can be applied and provides sealing by application of heat. Also, one can employ an unsupported acrylic film adhesive. This does not require the application of heat. The adhesive that uses the application of heat may be preferred in that this will make it easier to remove and replace the fingerboard, simply by the application of heat.

Figure 23:
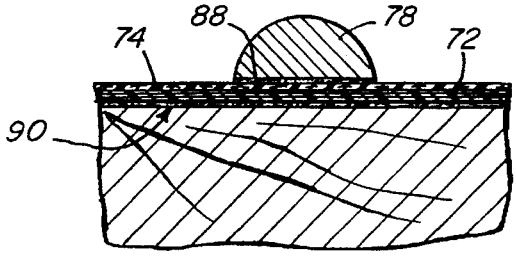
FIG. 23 is a cross-sectional view taken along line 23—23 of FIG. 21 showing the fret construction in accordance with the present invention.

Frets 23 may be bonded to the fret board laminate itself using instead a methylacrylate. Layer 88 for securing fret 78 to the laminate (FIG. 23). FIG. 23 also shows a thin film adhesive 90 for bonding the fingerboard structure to the guitar neck.

To secure the frets on the fingerboard, a material such as methylacrylate is particularly advantageous. Since it is an anarobic adhesive in which the cross-linking occurs in the absence of oxygen, only the concealed adhesive will harden and adhesive that is exposed to oxygen will not harden. This means that it will be easier to remove excess adhesive.

Figures 24, 25, 26:
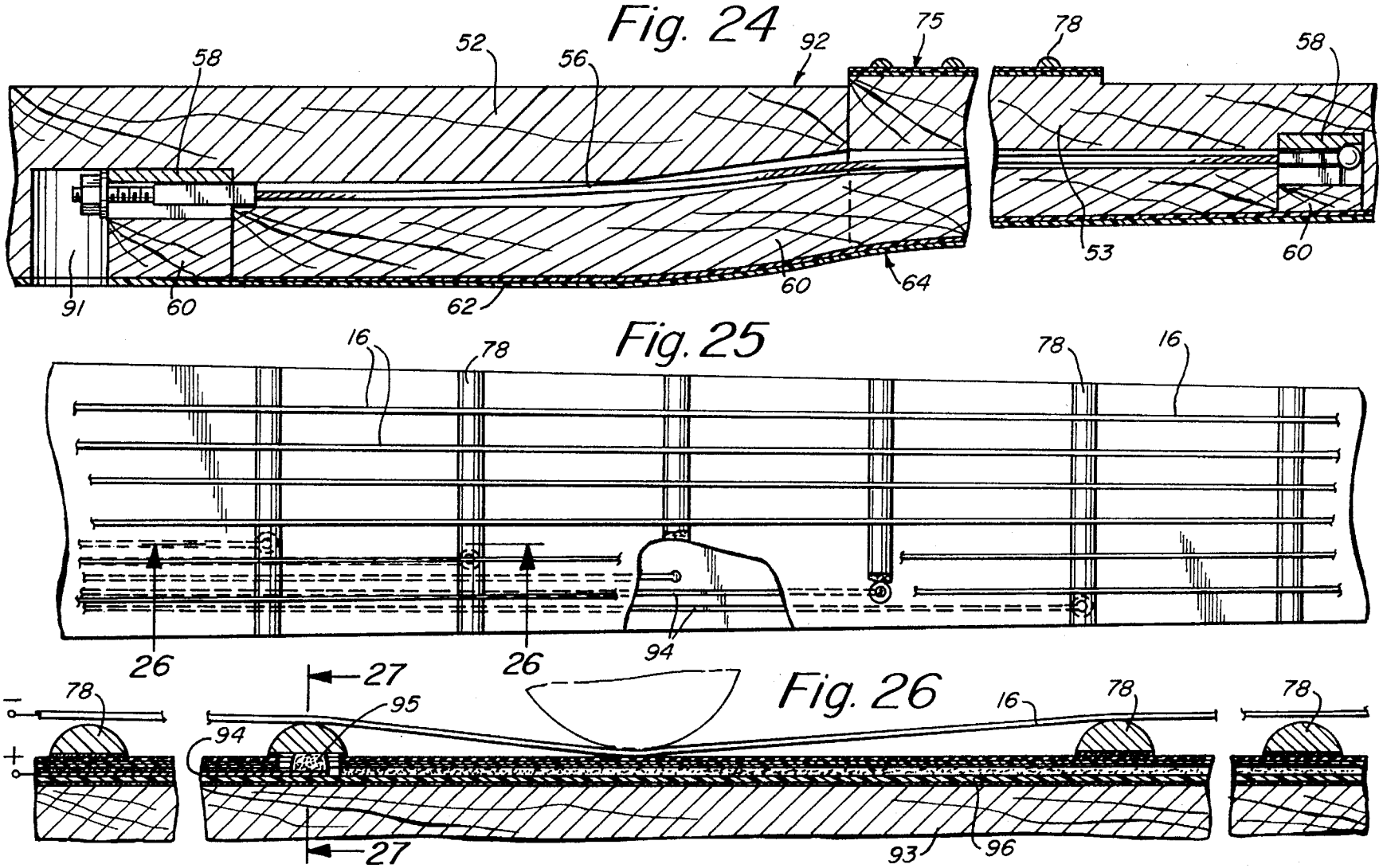
FIG. 24 is a longitudinal cross-sectional view taken along line 24—24 of FIG. 19.
FIG. 25 is a plan view partially in cross-section of a portion of the fingerboard.
FIG. 26 is a more detailed cross-sectional view as taken along line 26—26 of FIG. 25.

Reference is now made to FIG. 25 which is a longitudinal cross-sectional view taking along line 24—24 of FIG. 19. In FIG. 24, tensioning cable 56, which may be a stainless steel cable, is adapted to flex around any corners or curves. The ends of the cable are supported by anti-rotation devices 58. There is also a tension adjusting nut accessible from the hole 91. A portion of the fingerboard 75 is shown with the frets 78. The top surface 92 can be painted or may also be coated with at least fiberglass and perhaps also the carbon fiber. With the use of at least fiberglass coat there is a harder surface provided. FIG. 24 also shows the use of several wood filler strips 60. The underside surface is shown with its carbon fiber layer 62 and fiberglass layer 64. A heavy primer may be used to fill the rough surface of the fiberglass and then the instrument may be painted.

Figure 27:
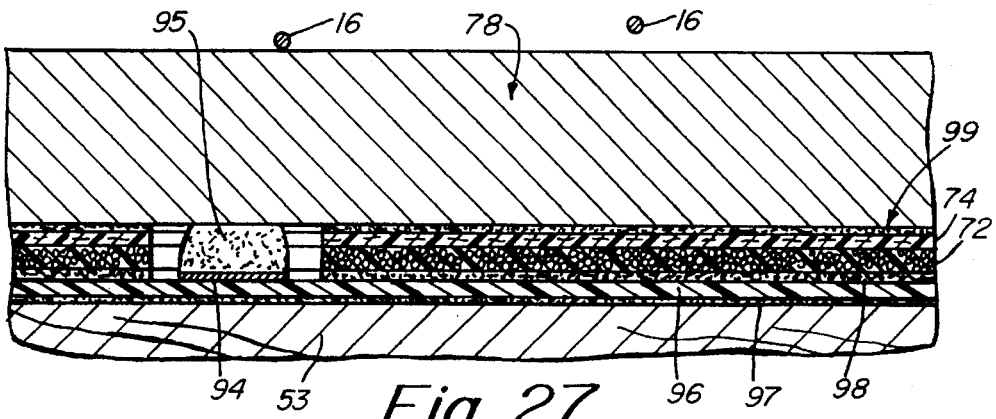
FIG. 27 is a further detailed cross-sectional view as taken along line 27—27 of FIG. 26.
Figure 28:
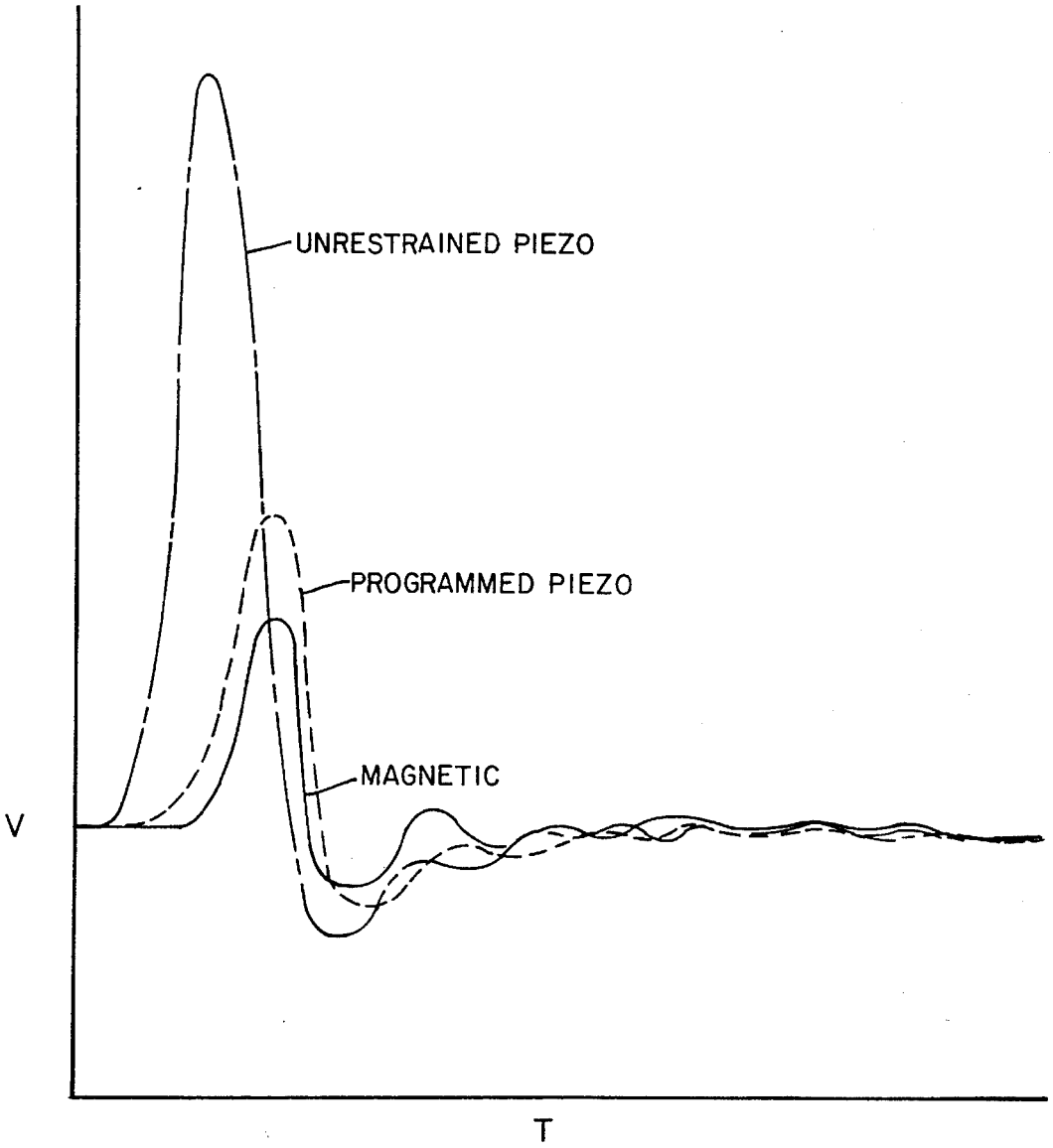
FIG. 28 is a graph relating to the transducer system described herein.
Figure 29:
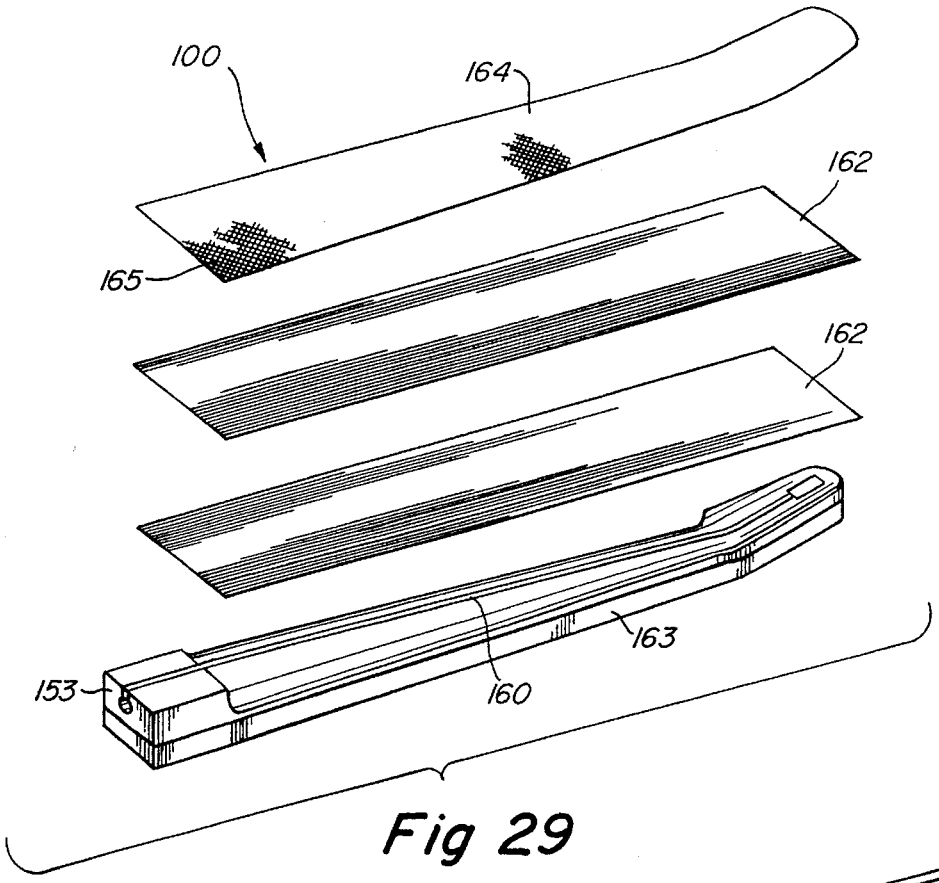
FIG. 29 is an exploded view of components employed in fabricating a guitar neck.

Referring to FIGS. 25–27, in an alternate embodiment of the invention, circuit runs are provided individually from each fret. When a fret is engaged with a finger such as that shown in FIG. 26, the conductivity between the string and the fret can be sensed by one of the circuit runs. Such a signal can be coupled by way of cable 30 to electronic device 32. In this way, one can electronically sense the particular fret that is being engaged when in fact the string causes conductivity with the particular fret.

FIG. 25 shows the series of frets 78, as well as strings 16 and circuit runs 94. As illustrated in FIG. 26, a conductive epoxy dab 95 completes the electrical conductivity from fret 78 to circuit run 94.

In the embodiment of the invention illustrated in FIGS. 25–27, on top of the wood core there is directly provided a printed circuit board including dielectric substrate 96 which carries the circuit runs 94. An adhesive 97 secures the printed circuit board substrate. FIG. 27 also shows circuit run 94 as well as conductive epoxy dab 95. A non-conductive epoxy layer 78 is employed over the substrate to isolate the circuit runs. Also, there is an epoxy layer 99 or alternatively a methylacrylate adhesive is provided to secure the frets.

FIGS. 29–34 illustrate a method for making an instrument component, with a guitar neck shown as an example of one such component. A light-weight guitar neck 100 includes a wood core 153 which may be a soft wood, a flexible wire 180, filler pieces 160, and one or more layers 162 of unidirectional carbon fiber, each of which may be about 0.010 inch thick. The layers of carbon fiber, two of which are illustrated, are impregnated with a high temperature epoxy resin. A pre-impregnated (prepreg) material can also be used. To prepare the neck for lamination, a stiff support caul 163 is provided to support the neck and the headstock in selected alignment, to provide a place for the extra laminating material to go, and to prevent excess laminating material from being bonded to the finger board surface. The caul is first treated with a silicone mold release material.

A fiberglass cloth layer 164 is applied over the carbon fiber layers 162 with a 45° bias, as illustrated at 165, to enable the fiberglass to conform to the curves of the neck. Layer 164 is about 0.003 inches thick and is preferably impregnated with a high temperature epoxy resin.

Figure 30:
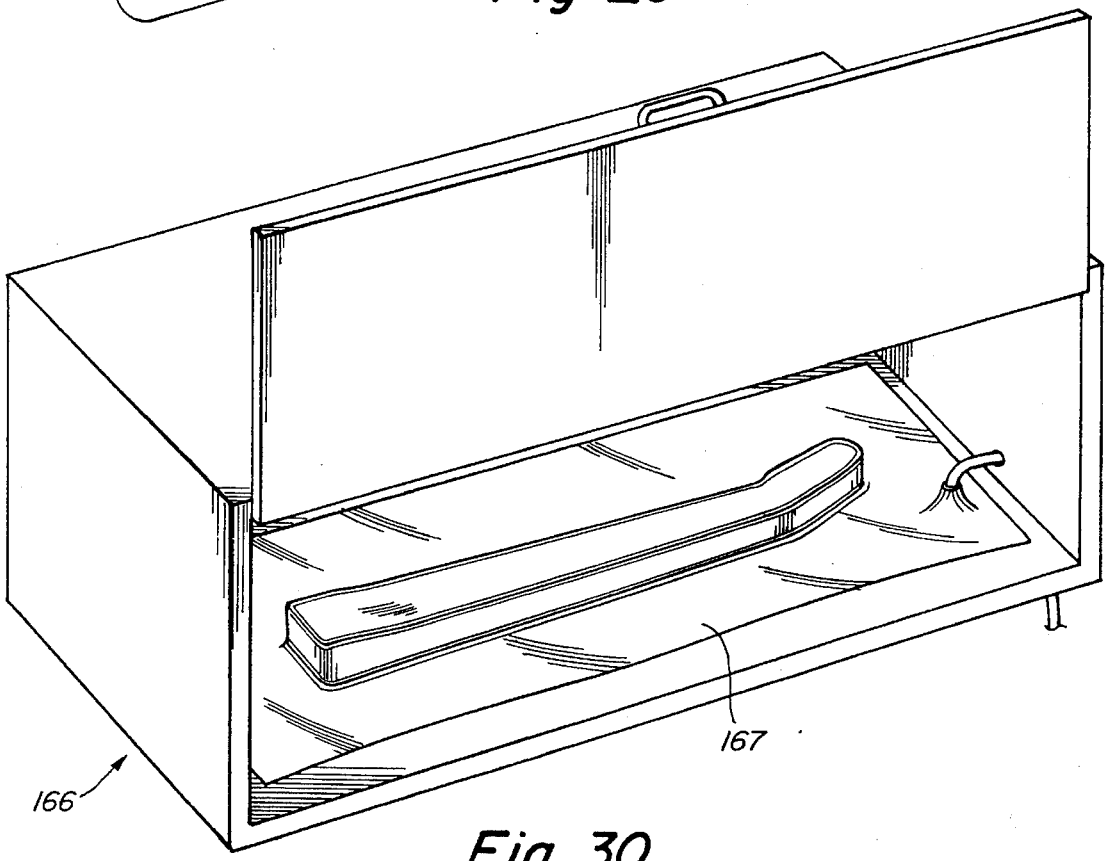
FIG. 30 is a perspective view of the guitar neck in an oven and vacuum bag for heating and curing.

After carbon fiber layers 162 and fiberglass layer 164 are impregnated with resin, they are pressed onto the neck core for curing. Referring to FIG. 30, the neck is placed in a vacuum bag 167 to provide clamping pressure for the lamination. The curing occurs in an oven 166 at a temperature of about 250° F. for about two hours.

After the neck is cured, the caul is removed, excess material is removed with a knife, and the laminated edges are smoothed. The headstock and fingerboard surfaces are then prepared. Sharp edges may be radiused by sanding, and excess material is trimmed.

Figure 31:
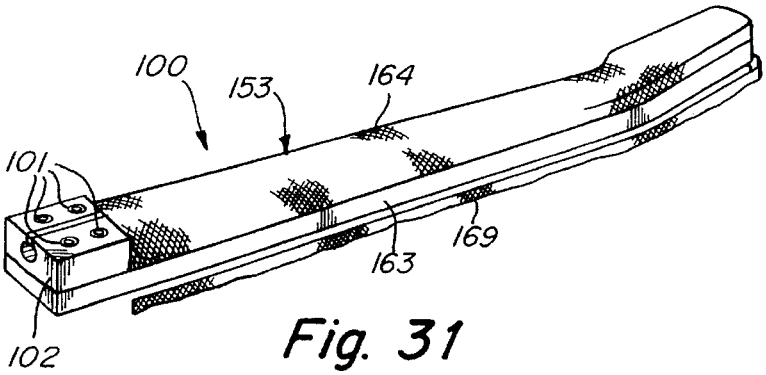
FIG. 31 is a perspective view of the guitar neck during construction according to the present invention.
Figure 32:
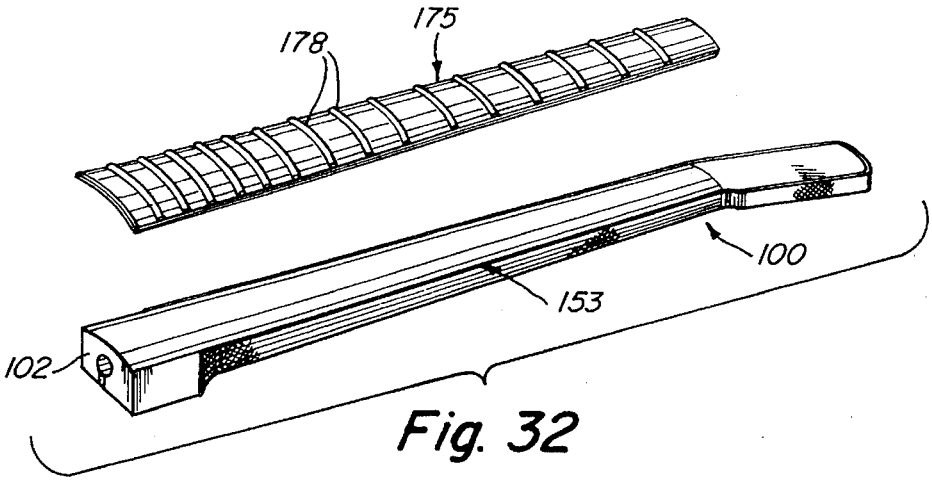
FIG. 32 is an exploded perspective view of the guitar neck and the fret board.

The light-weight neck may be secured to the body by a variety of methods, one of which is shown in FIGS. 31–34. Referring to FIG. 31, a series of threaded inserts 100 are disposed in core 153 at an end 102 of the neck. Referring to FIG. 32, fingerboard 175 with attached frets 178 is shown just prior to attachment of the fingerboard to the neck core 153.

Figure 33:
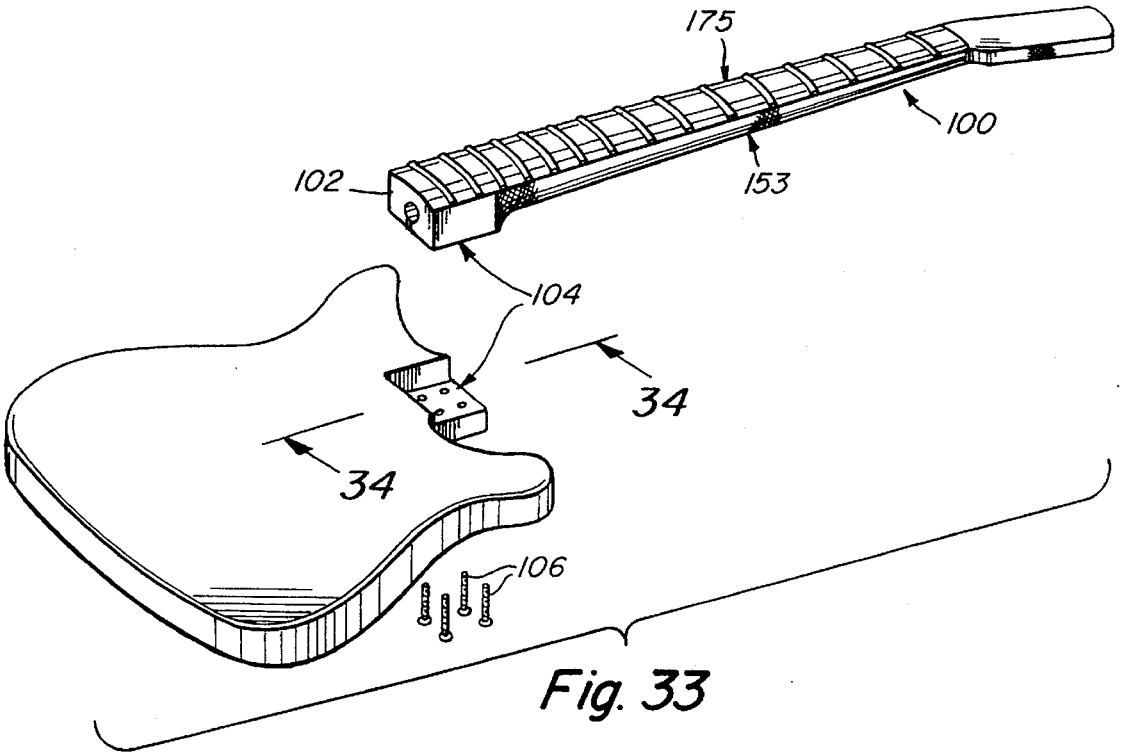
FIG. 33 is a perspective view of a guitar neck and guitar body.

Referring to FIG. 33, a half-lap joint 104 is constructed to join a planar surface of the guitar body and a planar surface at end 102 of light-weight neck core 153. A number of machine screws 106 are fed into screw holes the back of the guitar body and engage the threaded inserts in the neck. Other fitted joints, such as mortise and tenon joints can be constructed to engage respective surfaces of the guitar neck and guitar body. The neck and body may also be glued together. The fitted joints are typically used in conjunction with the glue.

Figure 34:
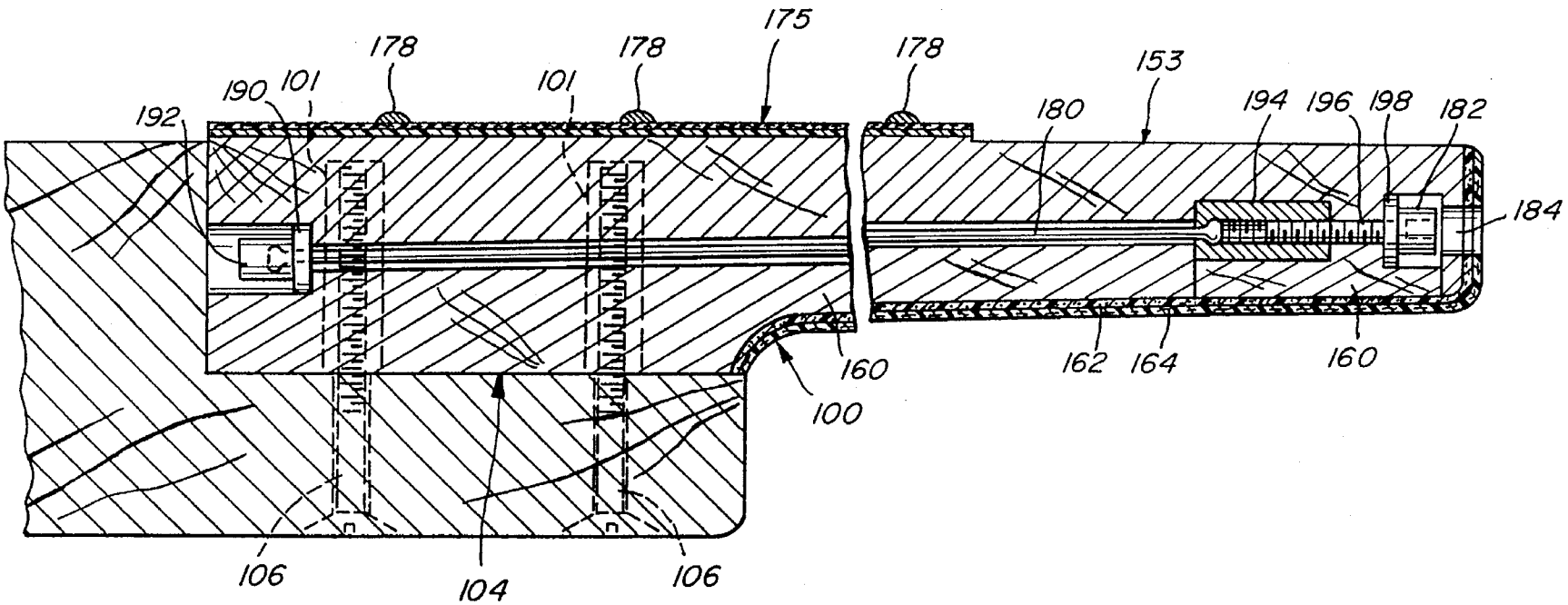
FIG. 34 is a cross-sectional view along 34—34 of FIG. 33.

Referring to FIG. 34, since the neck is formed as a separate piece, a tension wire 180 is provided completely within the neck. Wire 180 is preferably about 0.060 inches to about 0.078 inches and is preferably non-braided music wire. At the body end of the neck, a washer 190 is pressed against the opening for the wire, and a cap 192 is swaged over the end of the wire. Unlike some cables, since the wire is not braided, it is easier to swage. At the headstock end, an internally threaded anti-rotation fitting 194 is swaged onto the end of the wire. A washer 198, which is preferably made from metal, is placed over a screw 196 which is screwed into fitting 194. The tension adjusting screw is accessible through an opening 184 in the neck, and allows adjustment with an allen wrench, a screwdriver, a Torx wrench, or some other device that mates with screw head 182. Fitting 194 prevents rotation by having a rectangular shape and by being disposed in a slot that is also rectangular.

Having now described a number of embodiments of the present invention, it should now be apparent to those skilled in the art that numerous other embodiments and modifications thereof are contemplated as falling within the scope of the present invention as defined by the appended claims.

What is claimed is:

1. A method of constructing a light-weight stringed musical instrument neck comprising the steps of:

providing a strengthening layer and a thin fiberglass sheet as a finish layer over a wood neck core shaped as the instrument neck; and securing the layers as a laminate to a surface of the wood neck core.

2. The method of claim 1, wherein the providing step includes providing a thin layer of carbon fiber.

3. The method of claim 2, further including a step of providing a resin material in the laminate and applying heat to cure the layers.

4. The method of claim 3, wherein the applying step includes applying heat while subjecting the neck to a vacuum.

5. The method of claim 1, wherein the providing step includes providing multiple layers including carbon fibers.

6. A light-weight neck for stringed musical instrument comprising:

a wood core shaped as the neck of the instrument; and a laminate including:

a strengthening layer disposed over the core, and a finish layer including a thin, fiberglass sheet forming the outer surface of the neck.

7. The light-weight neck of claim 6, wherein the strengthening layer includes a layer having carbon fibers.

8. The light-weight neck of claim 7 including a resin material as part of the laminate and cured upon application of heat to form a hard outer finish surface.

9. The light-weight neck of claim 6, wherein the strengthening layer includes a plurality of layers having carbon fibers.

10. The light-weight neck of claim 6, wherein the wood core consists primarily of soft wood.

* * * * *